US009056242B2

(12) United States Patent
Decker et al.

(10) Patent No.: US 9,056,242 B2
(45) Date of Patent: Jun. 16, 2015

(54) UNIQUE BOARD GAME SIMULATING PUTTING MAKE-UP ON GIRLS SKETCH PADS

(71) Applicants: Debbie Decker, Arlington, VA (US); Lynn Enyart, Kingwood, TX (US)

(72) Inventors: Debbie Decker, Arlington, VA (US); Lynn Enyart, Kingwood, TX (US)

( * ) Notice: Subject to any disclaimer, the term of this patent is extended or adjusted under 35 U.S.C. 154(b) by 0 days.

(21) Appl. No.: 13/845,564

(22) Filed: Mar. 18, 2013

(65) Prior Publication Data

US 2013/0241148 A1 Sep. 19, 2013

Related U.S. Application Data

(60) Provisional application No. 61/611,854, filed on Mar. 16, 2012.

(51) Int. Cl.

| | |
|---|---|
| ***A63F 3/00*** | (2006.01) |
| ***A63F 9/06*** | (2006.01) |
| *A63F 9/00* | (2006.01) |

(52) U.S. Cl.

CPC ... *A63F 3/00003* (2013.01); *A63F 2003/00018* (2013.01); *A63F 2009/0049* (2013.01); *A63F 9/0641* (2013.01); *A63F 2009/0663* (2013.01); *A63F 2009/0665* (2013.01); *A63F 3/00006* (2013.01); *A63F 2003/00208* (2013.01)

(58) Field of Classification Search

CPC ..... A63F 2003/00208; A63F 2009/0663; A63F 2009/0665; A63F 2009/002; A63F 2009/0033

USPC ..... 273/243, 244, 259, 277

See application file for complete search history.

(56) References Cited

U.S. PATENT DOCUMENTS

| | | | | |
|---|---|---|---|---|
| 3,876,207 | A * | 4/1975 | Jones | 273/239 |
| 4,993,717 | A | 2/1991 | Fiske | |
| 5,078,409 | A * | 1/1992 | Butler et al. | 273/459 |
| 5,547,198 | A | 8/1996 | Kaiser | |
| 5,752,700 | A | 5/1998 | Delzotti | |

OTHER PUBLICATIONS

International Search Report/Written Opinion, PCT/US2013/032787, May 31, 2013.

* cited by examiner

*Primary Examiner* — Vishu Mendiratta
(74) *Attorney, Agent, or Firm* — McGuireWoods LLP

(57) ABSTRACT

The board game that allows girls be the first one to complete the makeover of their chosen girl on the sketch pad. Players move around the board trying to land on the designated spots to color or apply make-up to their girl. The first one to finish (brows, eye shadow, blush, lips and earrings), and get tiara without having the facemask on wins the game.

10 Claims, 5 Drawing Sheets

UNIQUE BOARD GAME SIMULATING PUTTING MAKE-UP ON GIRLS SKETCH PADS

CROSS-REFERENCE TO RELATED APPLICATION

This application is a non-provisional application of U.S. Provisional Patent Application No. 61/611,854, filed Mar. 16, 2012, entitled Girls Board Game, which is incorporated by reference herein in its entirety.

BACKGROUND OF THE INVENTION

1. Field of Invention

This invention relates to games and more specifically to girls board game for ages 6 and up.

2. Background of Related Art

Numerous board games have been provided in prior art that are adapted to entertain the players by challenging them so that they utilize their skills and acumen in playing the games while at the same time provide an element of chance to add a bit of adventure and luck to the games. While these units may be suitable for the particular purpose to which they address, they would not be as suitable for the purposes of the present invention as heretofore described.

SUMMARY OF THE INVENTION

For girls ages 6 and up where they use powdered chalk/make-up and colored pencils, crayons, etc. to make up the face on the sketch pad with a different girls face for each player. The object is to move their token (girl token matching the girl on players sketch pad) around the board, trying to land on spaces needed (brows, eyeshadow, blush, earrings and lips) to quickly complete the face on the players sketch pad. They compete against each other to get the girl on their sketch pad finished before the other make-up artists (players/opponents). They win by being the first to finish their girl's face, and getting the tiara, without having the facemask on. The first one to accomplish this wins the game.

Each player has a sketch pad with different artwork depicting girls face. They have to color in the eyebrows, eyelids, put blush on the cheeks, color the earrings on their ears and color the lips to finish the face. They compete against each other to get the girl on their sketch pad finished before the other make up artists (players/opponents). They win when their girls face is completed and they get the tiara, without having the facemask on to win. The game provides a unique method to play that involves skill and luck to win.

A further object is to provide an extremely fun game to play that will keep girls entertained for a long period of time. The instructions are simple and the game is easy to learn. It is appealing to a wide range of girls and has an alternative play for older girls. It provides a safe, creative and imaginative game that promotes being pretty on the inside. All girls are intrigued by make up at an early age. This is an extremely appealing game.

Another object is to provide a girls board game that is economical in cost to Manufacture.

This invention is unique when compared to other girls board games because it has a fun method of play (making up character's face on their pad) that is very appealing to girls ages 6 and up. The girls are acting as a make-up artist and competing to be the first to make up their character. It involves skill and luck to play and has playing cards that denote subjects that are very appealing to girls, such as fashion, being pretty on the inside, beauty tips, etc. Tokens are unique in that they depict the girls/characters.

The invention may be embodied in the form illustrated in the accompanying drawings, attention being drawn to the fact that the drawings are illustrative only, and that changes may be made in the specific construction illustrated and described within the scope of the appended claims.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

In the drawings:

FIG. 2 is a perspective view of the sketch pads depicting 4 different girls to do artwork on.

FIG. 9 is a perspective view of the game board with four stands, four sketch pads with different characters matching corresponding playing pieces, colored pencils, face mask, even cards depicting different events that girls needed a makeover for.

DETAILED DESCRIPTION OF THE PREFERRED EMBODIMENTS

Figure 1:
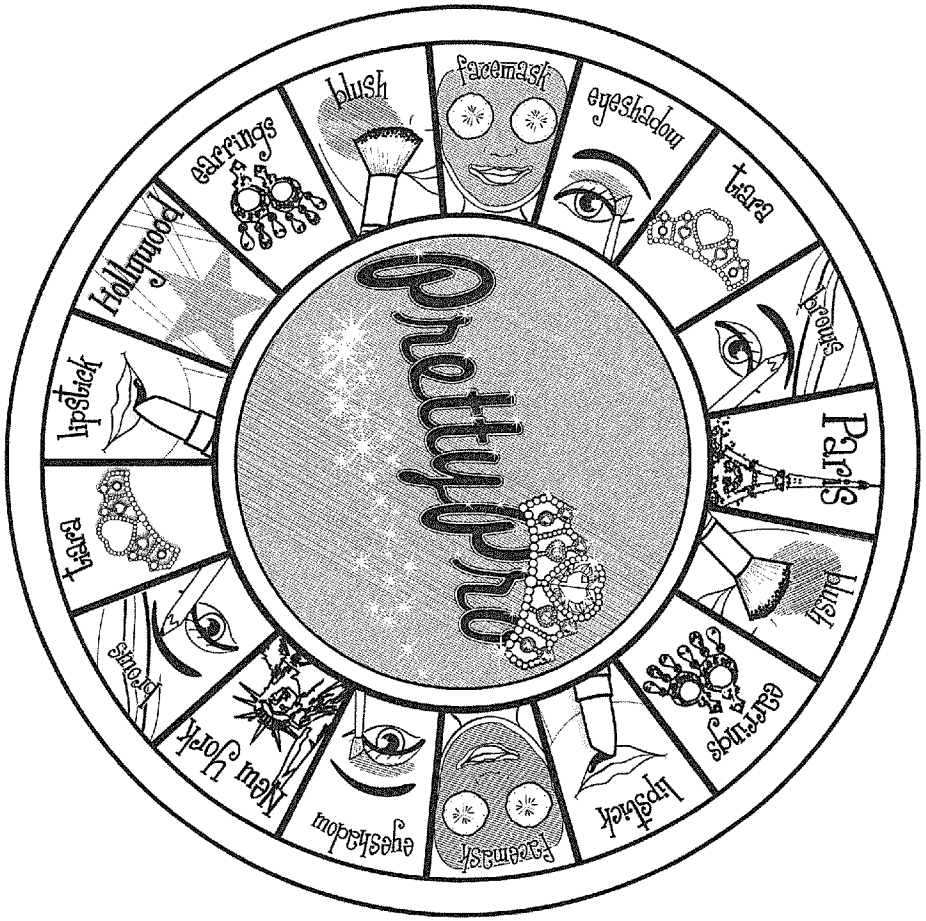
FIG. 1 is a perspective view of the game board.
Figure 2:
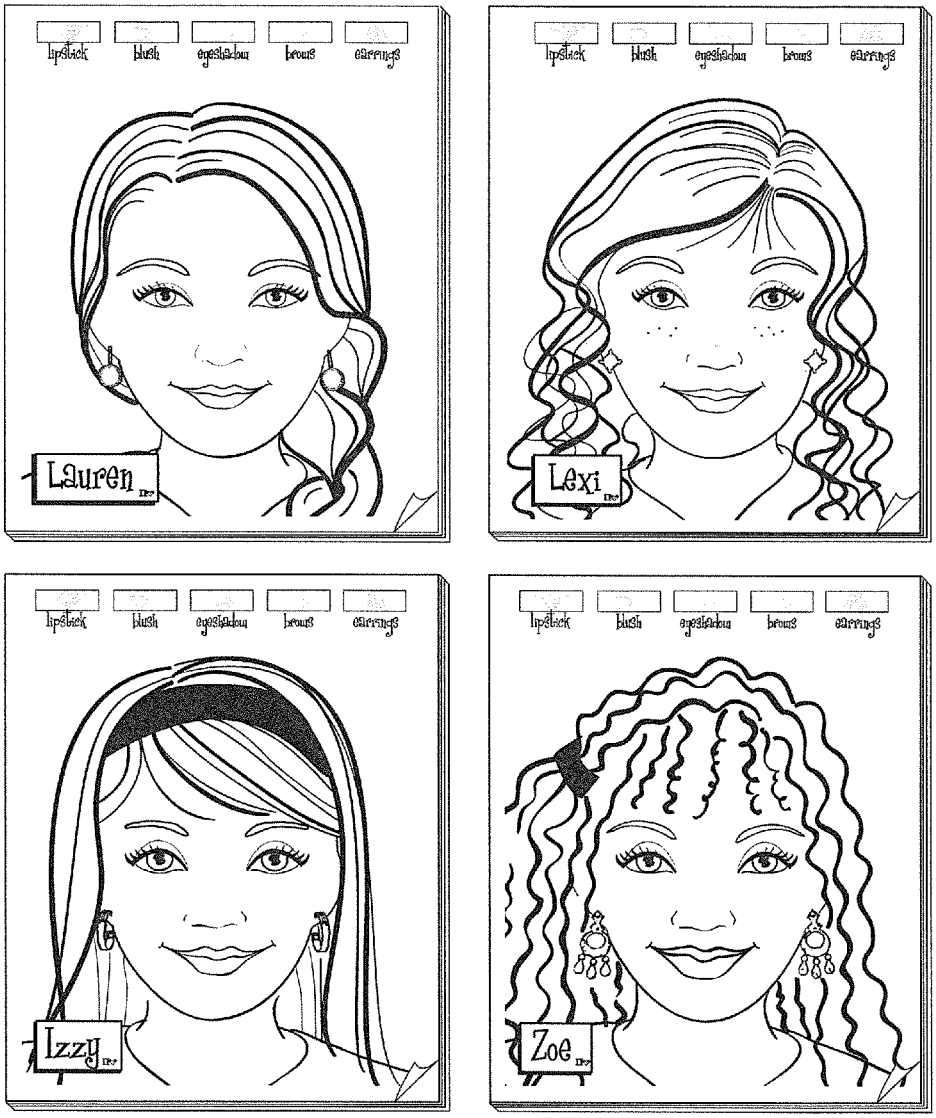
Figure 3:
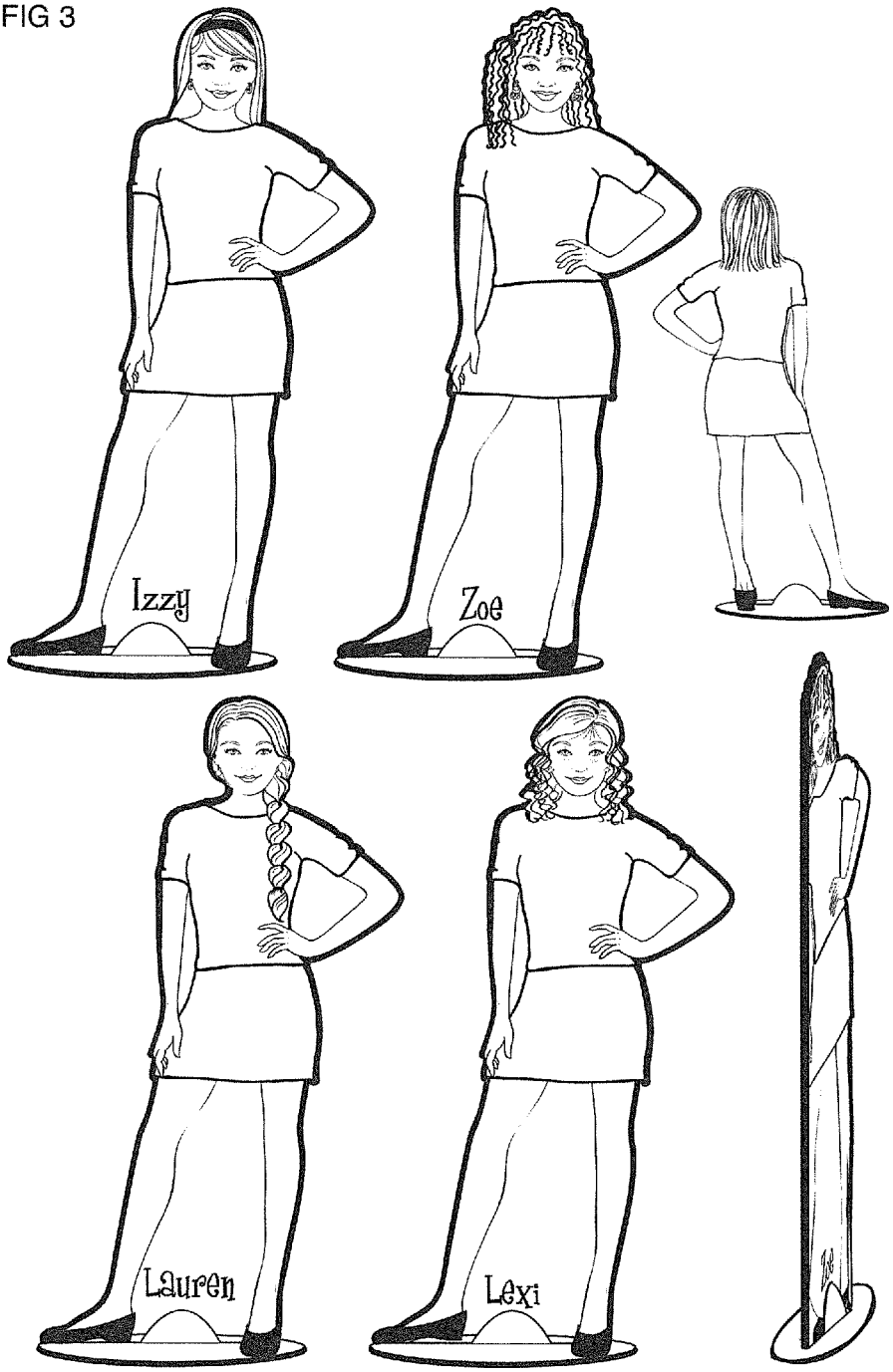
FIG. 3 is a perspective view of the playing pieces (token of girls that match corresponding pads).
Figure 4:
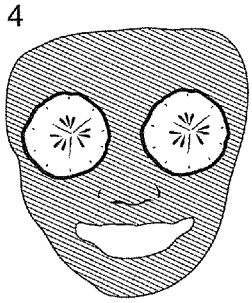
FIG. 4 is a perspective view of the face mask.
Figure 5:
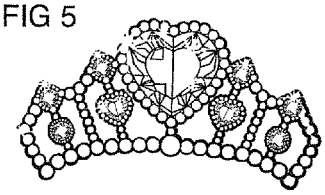
FIG. 5 is a perspective view of the Pretty Heart Tiara.
Figure 6:
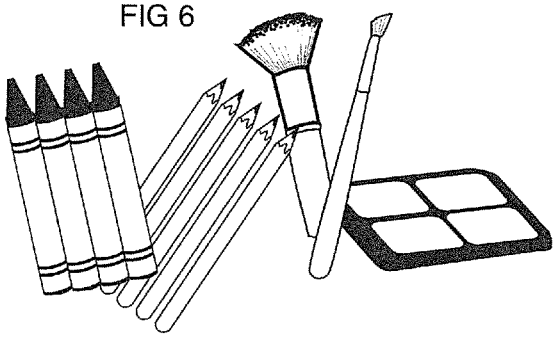
FIG. 6 is a perspective view of Colored Pencils/Crayons and the blush/eye shadow powder with brush/all/any coloring apparatus to be used on sketch pad.
Figure 7:
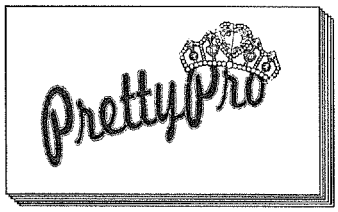
FIG. 7 is a perspective view of the Plying Cards.
Figure 8:
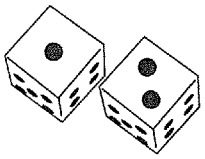
FIG. 8 is a perspective view of the dice.
Figure 9:
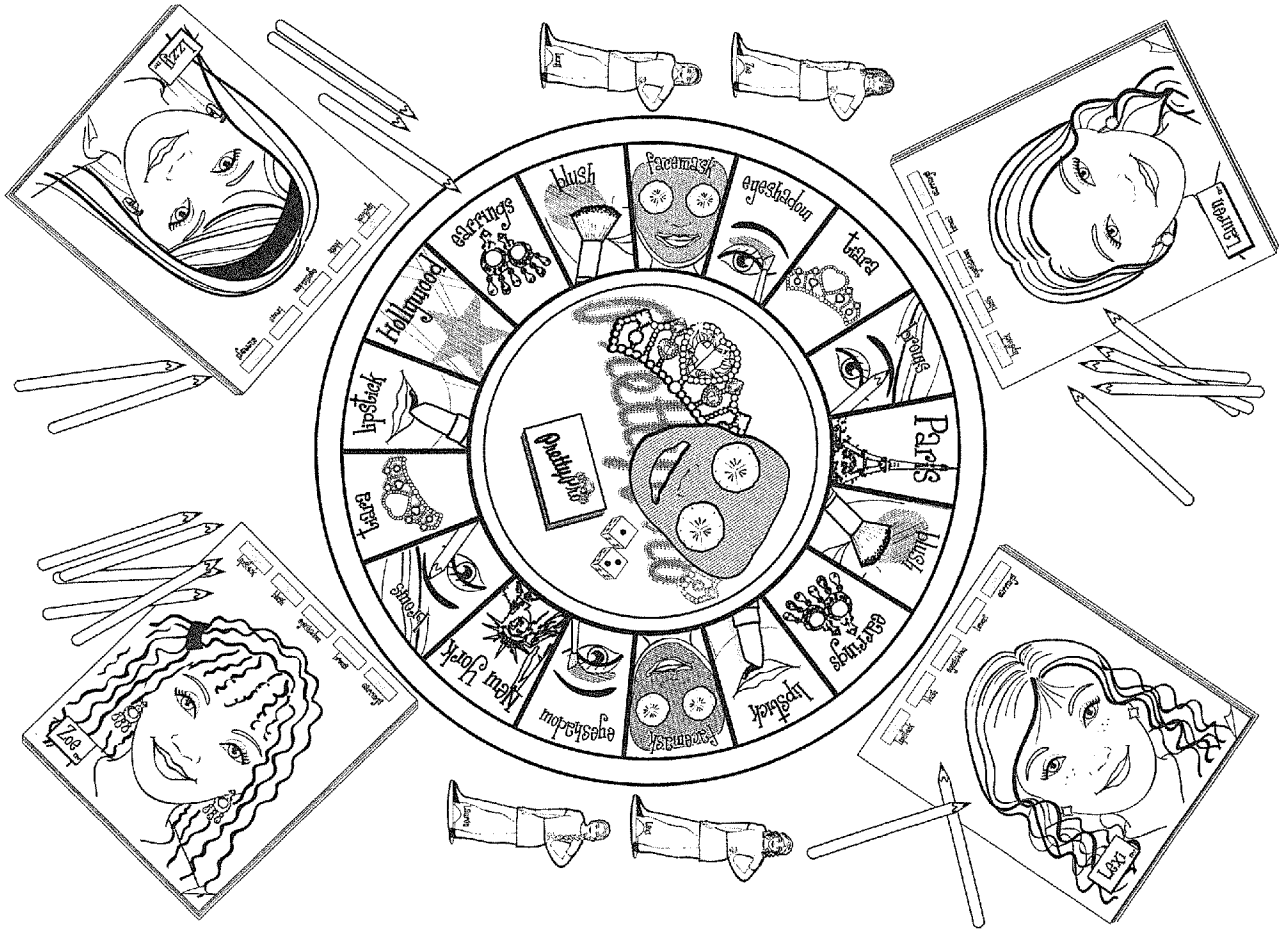

Turning now descriptively to the drawings, in which similar reference characters denote similar elements throughout the several views, FIG. 1 is a perspective view of the board game. The young girls board game consisting of a game board, 4 playing pieces, two dice, 4 sketch pads with artwork to match playing pieces, a face mask overlay, tiara, paying cards, powdered colors and brushes, colored pencils or crayons. The board is a continuous path in a circle with spaces. Players may start on any city. They do not all have to start on the same city. The other spaces tell what items to color in on the sketch pads. (brows, eyeshadow, earrings, blush and lips). There are two tiara spaces. Players put the tiara on the girls head on their sketch pad when they land on this spot. It is removed when another player lands on it and it is constantly moving from player to player. There are two facemask spaces. Players put the facemask on the girls face on their sketch pad when they land on this spot. It is removed when another player lands on the facemask spot and they have to put it on their sketch pad.

The player may still roll the dice and go when they have the facemask on their sketch pad, however, they may not color in any items on their pad until it comes off. If a player lands on the facemask spot when they already have the facemask on their sketch pad, they get to remove it and put it in the center of the board. The facemask is constantly moving during the game. The first player to complete their five items (brows, eyeshadow, blush, earrings and lips) and get the tiara without having the facemask wins the game.

The spaces on the board game starting clockwise from the Paris spot on the game board are as follows:

1. blush
2. earring
3. lipstick
4. face mask
5. eye shadow
6. New York
7. brows
8. tiara
9. lipstick
10. Hollywood
11. earrings
12. blush
13. face mask
14. eye shadow
15. tiara
16. brows
17. Paris Board game will fold in quarters.

The object of the game to be the first one to complete the makeover of the chosen girl on the sketch pad and capture the tiara before the other payers. Players move around the board trying to land on the designated spots to color or apply make-up to their girl. The first one to finish (eyebrows, eye\shadow, cheeks, lips and fingernails), get back to the designated city (Paris, Hollywood or, New York) and have the pretty heart tiara on (without having the face mask) wins the game.

Pieces:

1. Four stands and four girl tokens/characters matching girls on corresponding sketch pads.
2. 4 sketch pads with different artwork depicting 4 different characters to match the paying tokens.
3. 2 dice
4. 2 blush brushes
5. Powdered colors to use as eye shadow, blush or coloring
6. Colored pencils or crayons
7. Face mask overlay
8. Tiara
9. Playing cards Each player chooses a game piece (one of 4 girls) and the corresponding sketch pad with the matching girl. Place make-up and brushes, colored pencils, facial mask overlay, tiara and playing cards (face down) in the center of the board. Each player chooses a game piece (one of the four girls) and the corresponding matching girl on the sketch pads.

Put playing piece in a stand and place on any of the cities to start (New York, Paris or Hollywood). Players do not have to be on the same city to start. They can be on different cities.

Players roll one die to see who goes first. The player with the highest number goes first. Other players follow in turn clockwise. The first player rolls both dice and moves their token clockwise.

If a player rolls doubles, they do NOT get to go again.

If they land on the brows spot, earrings, blush or eye shadow they color in both of those items on their sketch pad. If they land on lips, they color in the lips. They can use either the make-up or colored pencils.

After each item is colored or made up on their sketch pad, they check off the corresponding box at the top of the pad so it is easy for them and other players to see what is needed to win the game with a quick glance.

If they land on something they already colored in, they do nothing and their turn is over.

If a player lands on the tiara spot, they take the tiara from the center of the board or from any other player that may have it on their pad and place it on their girls head on their pad. If a player lands on the tiara spot on the board but they already have it on their girls head, they do nothing and their turn is over. There is not a spot to check off the tiara on the pad because the tiara will be moving from player to player throughout the game and each player may have it several times during the game.

If a player lands on the face mask spot, they must remove it from the center of the board or from any other players that have it on their pad. When a player has it on their pad, they can roll the dice and go when it is their turn, however, they may not color in any items while the mask is on. If a player already has the facemask on their girl and that player lands on one of the facemask spots, they get to remove it and put it back in the center of the board.

If a player lands on any of the city spots during the game, they draw a card from the deck and do what it says. If they get a freebie card, they get to choose any one item needed to color it in (brows, eyeshadow, blush, earrings, or lips). They may not choose the pretty heart tiara. If a player draws a freebie card while they have the face mask on their pad, they do NOT get to color an item in and their turn is over. As players use a card, they put in a discard pile. Once all cards are used, shuffle them and turn them over to use again.

Once players have completed their make-over (brows, eye shadow, lips and earrings) they must capture the pretty heart tiara without having the facemask to win.

In another preferred embodiment, Players can choose to put the facemask on an opponent, instead of themselves, when they land on one of the facemask spots. It comes off when another person lands on it and they can choose to put it on another opponent or if the person wearing the facemask lands on the facemask spot and they choose to put it on another player.

For older girls—can purchase make-up separately and use that on the pads for a more realistic make up artist experience.

This board game is unique when compared to other girls games because it has a fun action/skill (making up characters on their pad) that is very appealing to tweens. It involves skill and luck to play and has playing cards that denote subjects that are very appealing such as fashion, being pretty on the inside, beauty tips , etc.

Having thus described preferred embodiments, it should be apparent to those skilled in the art that certain advantages of the described method and apparatus have been achieved. It should also be appreciated that various modifications, adaptations, and alternative embodiments thereof may be made within the scope and spirit of the present invention. The invention is further defined by the following claims.

What is claimed is:

1. A board game comprising:

a plurality of character playing pieces;

a plurality of sketch pads, each page of each of the plurality of sketch pads depicting a face of a character of one of the plurality of character playing pieces, wherein at least one sketch pad is provided for each of the plurality of character playing pieces;

a plurality of make-up application items, including colored pencils, for simulating the application of make-up to the face on the plurality of sketch pads;

a tiara overlay configured to be placed over one of the plurality of sketch pads;

a substantially flat, face-shaped face mask overlay configured to be placed over one of the plurality of sketch pads;

a game board having a continuous path around its perimeter divided into consecutive spaces, the consecutive spaces comprising at least one starting space, at least one tiara overlay space, at least one face mask overlay space, and a plurality of sketch pad make-up application spaces indicating a portion of the sketch pad to color in; and means for producing random numeric designations representing travel movements for each said character playing piece along the continuous path.

2. The board game as recited in claim 1, wherein said means for producing random numeric designations comprises a die.

3. The board game as recited in claim 1, wherein the plurality of make-up application items include at least one of blush, lipstick, eyebrow pencil, and eyeshadow.

4. The board game as recited in claim 1, wherein said game board is a circle and the continuous path of the spaces forms a further inner circle within the perimeter of said board game.

5. The board game as recited in claim 4, wherein said game board further includes two fold lines for folding the game board into quarters.

6. The board game of claim 1, wherein each of the plurality of sketch pads comprises checkboxes corresponding to each of a plurality of features on the face, wherein the checkboxes are checked off when a player colors in the designated feature on the face.

7. The board game of claim 1, wherein each of the plurality of sketch pad make-up application spaces includes an instruction to color in, on one of the plurality of sketch pads, one of brows, eye shadow, blush, earrings, and lips.

8. The board game of claim 1, further comprising:

a deck of playing cards defining actions to be taken by a player, a card from the deck of playing cards being selectable when a player lands on the at least one starting space during play.

9. The board game of claim 8, wherein the deck of playing cards includes:

at least one card instructing a player to color in, on one of the plurality of sketch pads, any one item that has not been colored in.

10. The board game of claim 8, wherein each card in the deck of playing cards includes fashion or beauty tip, at least one of the cards including a tip for inner beauty.

* * * * *